US006516813B2

(12) United States Patent
Yiu

(10) Patent No.: US 6,516,813 B2
(45) Date of Patent: Feb. 11, 2003

(54) THERMAL FINGER NAIL DECAL ATTACHING DEVICE

(76) Inventor: Chih-Hao Yiu, 7F-1, No. 30, Lin-Shen Rd., Taichung City (TW)

( * ) Notice: Subject to any disclaimer, the term of this patent is extended or adjusted under 35 U.S.C. 154(b) by 0 days.

(21) Appl. No.: 09/873,201

(22) Filed: Jun. 4, 2001

(65) Prior Publication Data

US 2002/0157679 A1 Oct. 31, 2002

(30) Foreign Application Priority Data

Apr. 25, 2001 (TW) ..... 090206563

(51) Int. Cl.[7] ..... A45D 29/00

(52) U.S. Cl. ..... 132/73; 156/541; 156/581; 427/148

(58) Field of Search ..... 132/200, 73, 73.5, 132/73.6, 75.8, 285; 156/540, 541, 580, 581, 230, 238, 240, 247, 289; 427/146, 147, 148

(56) References Cited

U.S. PATENT DOCUMENTS 3,598,685 A * 8/1971 Lee et al. ..... 132/73
3,886,020 A * 5/1975 Shank, Jr. ..... 156/211
3,898,357 A * 8/1975 Miller et al. ..... 428/42
3,958,051 A * 5/1976 Smith ..... 428/42
4,369,082 A * 1/1983 Kerwin ..... 156/238
4,511,425 A * 4/1985 Boyd et al. ..... 156/493
5,300,170 A * 4/1994 Donohoe ..... 156/235
5,382,313 A * 1/1995 Eminger ..... 156/583.1
6,318,377 B1 * 11/2001 Folks et al. ..... 132/73
6,378,590 B1 * 4/2002 Allen et al. ..... 156/542
6,286,517 B1 * 9/2002 Weber et al. ..... 132/73

* cited by examiner

*Primary Examiner*—Todd E. Manahan
*Assistant Examiner*—David C. Comstock
(74) *Attorney, Agent, or Firm*—Charles E. Baxley

(57) ABSTRACT

A finger nail decal attaching device includes a base member having a recess for receiving finger therein. A strip driven by two mandrels is movably located above the base member and a plurality of decals are connected to the strip. A heating member is located beside the strip and softens the decals. A pressing member has a rod and a soft pad which is connected to a first end of the rod and located above the strip. The rod is moved toward the strip by pivoting a lever connected to the rod.

4 Claims, 4 Drawing Sheets

THERMAL FINGER NAIL DECAL ATTACHING DEVICE

FIELD OF THE INVENTION

The present invention relates to a finger nail decorations attaching device which has a recess for receiving fingers, a strip of multiple decorations moves over the finger nail, a heating member for softening the decorations and a pressing member to press the decorations on the finger nails.

BACKGROUND OF THE INVENTION

One of the conventional ways to decorate finger nails is to spread colored nail polish by an applicator. This conventional way requires skill to spread the nail polish evenly and can only have simple patterns. Another conventional way to decorate finger nails is to attach a pattern decal on the nail directly. However, how to firmly and evenly attach the decal on a curved finger nail is a key point of using the finger nail attachment. Generally, a certain level of skill is required to attach the decal evenly on the nail without knurls. The operators have to put the decals on the finger nails one by one and press them one by one. This takes a long period of time. During the pressing processes, the decals could be shifted so that the operators have to adjust the positions of the decals frequently and this will reduce the efficiency of the attachment between the decals and the finger nails.

The present invention intends to provide a finger nail decorations attaching device that employs proper mechanisms to firmly press decals on the nails so as to save time and obtain a good result.

SUMMARY OF THE INVENTION

In accordance with one aspect of the present invention, there is provided a finger nail decorations attaching device and comprises a base member having a recess defined in a top thereof for receiving a finger therein and a strip with a plurality of decals is movably located above the base member. A heating member for heating the decals is located besides the strip. A pressing member has a rod and a soft pad is connected to a first end of the rod. The soft pad is lowered to press the decal on the finger nail by moving the rod.

The primary object of the present invention is to provide a finger nail decorations attaching device wherein the decals can be put on the nails precisely and are pressed by a rod to ensure that the decals are firmly and evenly pressed on the nails.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
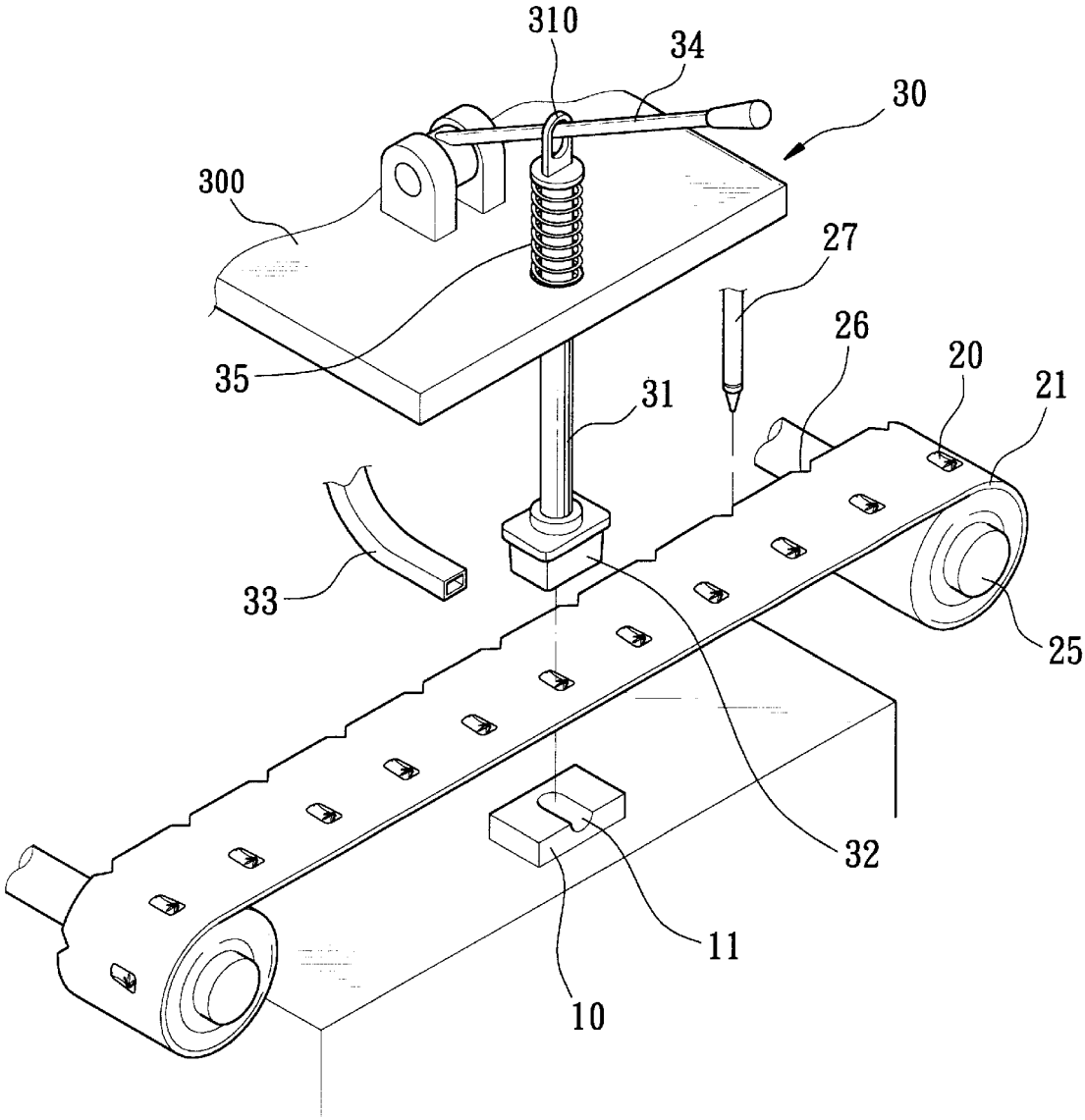
FIG. 1 is an exploded view to show a finger nail decorations attaching device of the present invention.
Figure 2:
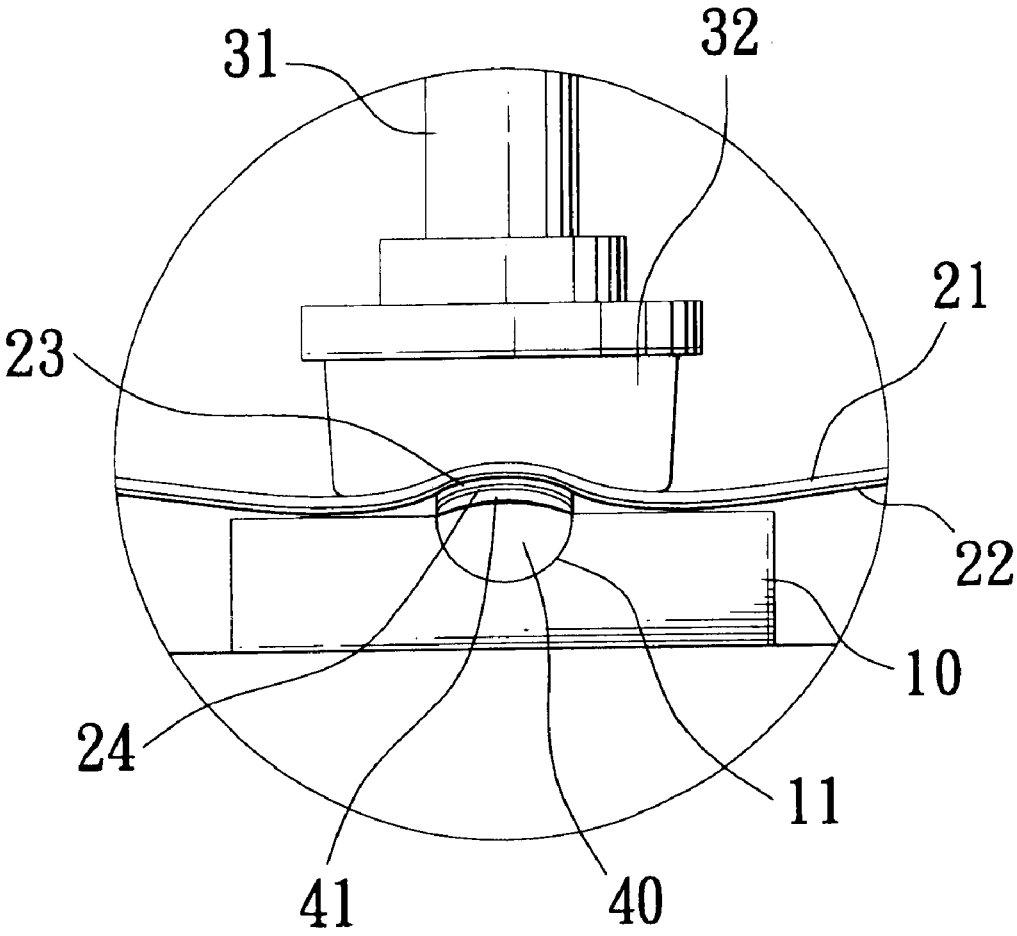
FIG. 2 is a side enlarged view to show the decal is pressed on a finger nail in the finger nail decorations attaching device of the present invention.
Figure 3:
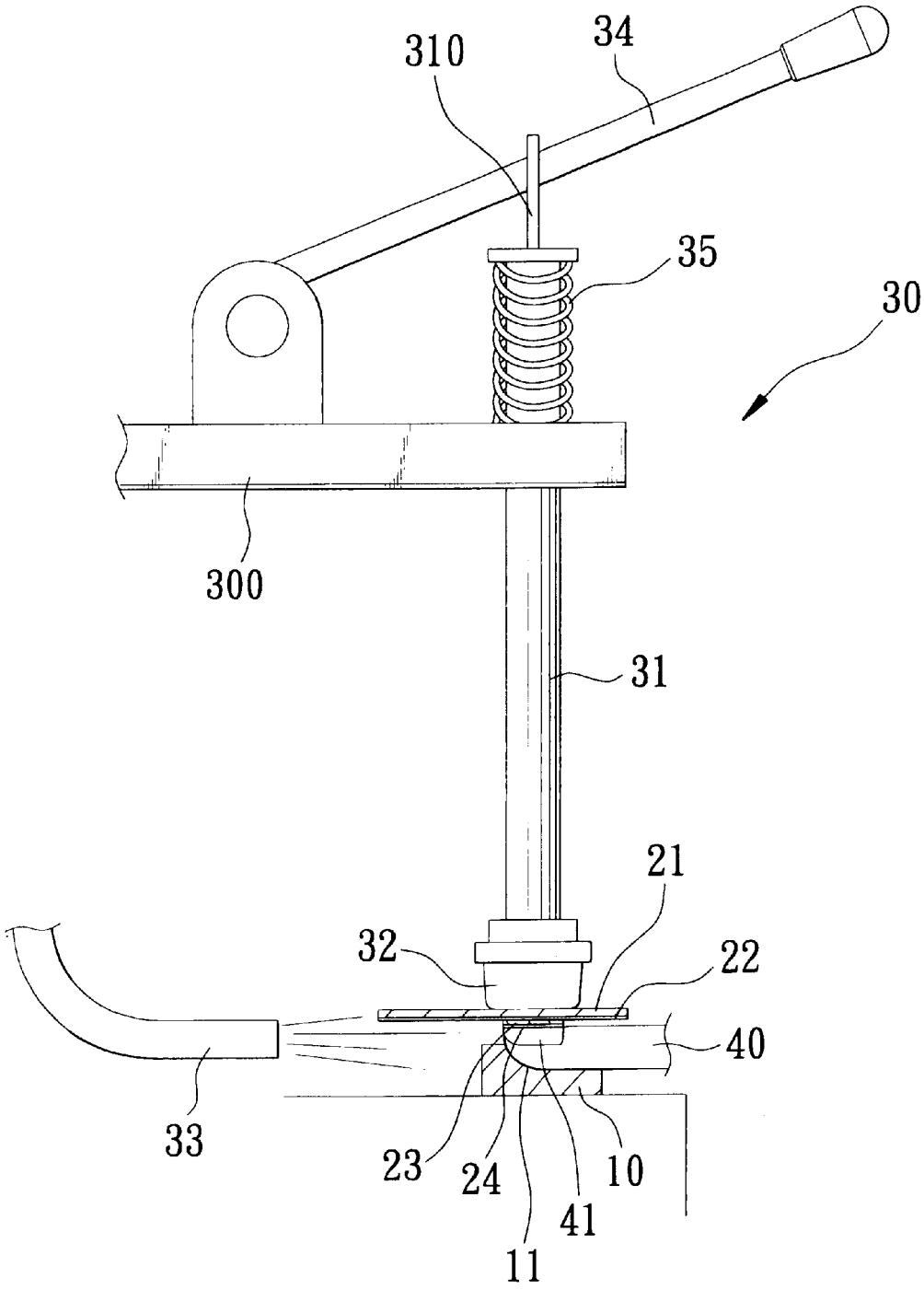
FIG. 3 is a side view to show the decal is pressed on a finger nail in the finger nail decorations attaching device of the present invention.

Referring to FIGS. 1 to 3, the finger nail decorations attaching device of the present invention comprises a base member 10 having a recess 11 defined in a top thereof so as to receive a finger 40 therein. The nail 41 of the finger 40 slightly protrude above the surface of the base member 10. A strip 21 is movably located above the base member 10 and a plurality of decals 20 are connected to the strip 21. The base member 10 is located between two mandrels 25 and two ends of the strip 21 are respectively wrapped on the two mandrels 25, so that the strip 21 is driven by the mandrels 25 which can be controlled by proper mechanisms. Each decal 20 includes a pattern ink layer 23. A releasing layer 22 is located between the pattern ink layer 23 and the body of the strip 21. A glue layer 24 is located on the bottom of the pattern ink layer 23. The strip 21 has notches 26 defined in a side thereof and a detection member 27 detects positions of the notches 26. By the detection from the detection member 27, the positions of the decals 20 can be precisely controlled.

A heating member 33 for heating the decals 23 is located beside the strip 21 and the glue layer 24 is heated and softened by the heating member 33 so as to easily attach the decal 20 on the nail 41. The heating member 33 can be electrical, micro-wave, or any known method. A pressing member 30 comprises a board 300 through which a rod 31 movably extends. A soft pad 32 is connected to a first end of the rod 31 and located above the strip 21. A ring member 310 is fixedly connected to a second end of the rod 31 and a lever 34 extends through the ring member 310. The lever 34 is pivotally connected to the board 300. A spring 35 is mounted to the rod 31 and two ends of the spring 35 respectively contact the board 300 and the ring member 31. When the finger 40 is put in the recess 11, the strip 21 is moved to desired position above the nail 41 and the rod 31 is lowered by pulling the lever 34. The glue layer 24 is softened by the heating member 33 and the decal 20 is pressed on the nail 41 by the soft pad 32 and the pattern ink saver 23 is attached on the nail 41. The releasing layer 22 assists the strip 21 to separate from the pattern ink layer 23. The lever 34 is returned by the spring force 35.

Figure 4:
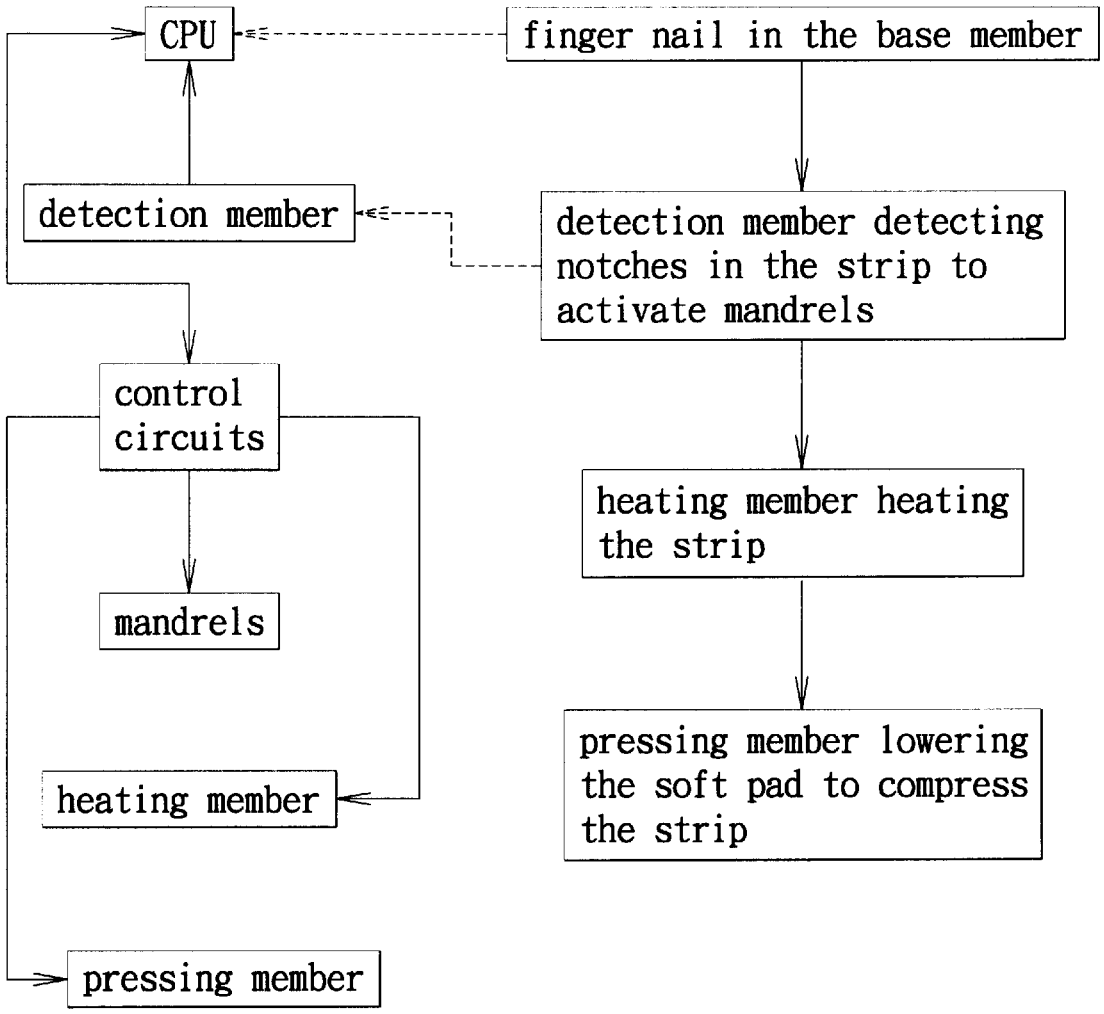
FIG. 4 shows a flow chart for controlling the finger nail decorations attaching device of the present invention.

FIG. 4 shows the steps of the operation of the device, which can be controlled by a CPU 50, and the control circuits 51 which control the mandrels 25, the heating member 33, and the pressing member 30.

While we have shown and described the embodiment in accordance with present invention, it should be clear to those skilled in the art that further embodiments may be made without departing from the scope of the present invention.

What is claimed is:

1. A finger nail decorations attaching device comprising:

a base member having a recess defined in a top thereof, a strip movably located above said base member and a plurality of decals connected to said strip;

a heating member for heating said decals;

a pressing member having a rod and a soft pad connected to a first end of said rod and located above said strip.

2. The device as claimed in claim 1 further comprising two mandrels between which said base member is located, two ends of said strip respectively wrapped on said two mandrels.

3. The device as claimed in claim 1, wherein said strip has notches defined in a side thereof and a detection member detects positions of said notches.

4. The device as claimed in claim 1 further comprising a board through which said rod movably extends and a lever pivotally connected to said board, a ring member fixedly connected to a second end of said rod and said lever extending through said ring member, a spring mounted to said rod and two ends of said spring respectively contacting between said board and said ring member.

* * * * *